US007233762B2

(12) United States Patent
Kunii et al.

(10) Patent No.: US 7,233,762 B2
(45) Date of Patent: Jun. 19, 2007

(54) METHOD OF UNIFORMLY FIXING TONER TO RECORDING MEDIUM IN IMAGE FORMING APPARATUS

(75) Inventors: Hiroyuki Kunii, Kanagawa (JP); Katsuhiro Echigo, Saitama (JP); Hisashi Kikuchi, Kanagawa (JP); Atsushi Nakafuji, Tokyo (JP); Yukimichi Someya, Saitama (JP); Shigeo Kurotaka, Kanagawa (JP); Toshihiko Baba, Tokyo (JP); Kohji Ue, Kanagawa (JP); Takashi Fujita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 106 days.

(21) Appl. No.: 11/083,157

(22) Filed: Mar. 18, 2005

(65) Prior Publication Data

US 2005/0207801 A1 Sep. 22, 2005

(30) Foreign Application Priority Data

Mar. 18, 2004 (JP) ..... 2004-078502

(51) Int. Cl.
*G03G 15/16* (2006.01)
*G03G 15/20* (2006.01)

(52) U.S. Cl. ..... 399/307; 219/216; 399/340; 430/124

(58) Field of Classification Search ..... 399/307, 399/320, 302, 308, 340, 328, 329; 219/216; 347/156; 430/124, 126
See application file for complete search history.

(56) References Cited

U.S. PATENT DOCUMENTS 6,002,907 A * 12/1999 Berkes ..... 399/307
6,042,917 A * 3/2000 Schlueter et al. ..... 399/302 X
6,173,147 B1 * 1/2001 Nakashima et al. ..... 399/308
6,377,771 B1 * 4/2002 Verluyten et al. ..... 399/302
6,577,837 B2 * 6/2003 Iida et al. ..... 399/307
2002/0051659 A1 * 5/2002 Baba et al. ..... 399/307

(Continued)

FOREIGN PATENT DOCUMENTS

JP 5-19642 1/1993

(Continued)

OTHER PUBLICATIONS

U.S. Appl. No. 11/511,380, filed Aug. 29, 2005, Suzuki et al.

(Continued)

*Primary Examiner*—Sophia S. Chen
(74) *Attorney, Agent, or Firm*—Oblon, Spivak, McClelland, Maier & Neustadt, P.C.

(57) ABSTRACT

An unfixed toner image on a transferring and fixing belt is passed through a pair of toner integrating rollers. A surface side of the toner integrated that is in contact with a paper, is heated by a halogen heater to impart a tackiness required for fixing. As a result of this, a temperature of a surface side of the toner that is in contact with the transferring and fixing belt is not as high as a temperature of the surface side of the toner that is in contact with the paper. Therefore, even if the toner is pressurized, and transferred and fixed at a fixing nip, a difference in an area of the toner is small. This enables to achieve a good image quality.

26 Claims, 6 Drawing Sheets

U.S. PATENT DOCUMENTS

| | | | | |
|---|---|---|---|---|
| 2004/0037595 | A1* | 2/2004 | Takashi et al. | 399/307 |
| 2004/0126153 | A1* | 7/2004 | Koga et al. | 399/307 |
| 2004/0131402 | A1* | 7/2004 | Kurotori et al. | 399/340 |
| 2005/0025534 | A1* | 2/2005 | Fujita et al. | 399/307 |

FOREIGN PATENT DOCUMENTS

| | | | |
|---|---|---|---|
| JP | 9-114282 | | 5/1997 |
| JP | 9-230646 | | 9/1997 |
| JP | 9-269677 | | 10/1997 |
| JP | 3055449 | B2 | 4/2000 |
| JP | 2000-275982 | | 10/2000 |
| JP | 2001-13798 | | 1/2001 |
| JP | 2002-202673 | A * | 7/2002 |
| JP | 2004-109751 | A * | 4/2004 |

OTHER PUBLICATIONS

U.S. Appl. No. 11/521,494, filed Sep. 15, 2006, Takagaki et al.

* cited by examiner

METHOD OF UNIFORMLY FIXING TONER TO RECORDING MEDIUM IN IMAGE FORMING APPARATUS

CROSS-REFERENCE TO RELATED APPLICATIONS

The present document incorporates by reference the entire contents of Japanese priority document, 2004-078502 filed in Japan on Mar. 18, 2004.

BACKGROUND OF THE INVENTION

1) Field of the Invention

The present invention relates to a technology for uniformly fixing toner on a recording medium.

2) Description of the Related Art

A conventional image forming apparatus including an image transferring and fixing device, which transfers to and fixes on a recording medium an unfixed image on an image carrier, has been disclosed in Japanese Patent Application Laid-open Publication No. H9-114282 (page 5, FIG. 1). This image forming apparatus includes an image carrier, an intermediate transfer belt, a heating roller, and a pressurizing roller. The image carrier is in the form of a belt. The intermediate transfer belt is an endless belt that performs an orbital motion, and is disposed such that it is in contact with the image carrier. The heating roller melts a toner image that is transferred to the intermediate transfer belt, by heating the toner image to a temperature not lower than a melting temperature of a toner. The pressurizing roller comes in contact, through the intermediate transfer belt, with a supporting roller that is disposed on a downstream side of the heating roller and supports the intermediate transfer belt. The toner image on the intermediate transfer belt is transferred to and fixed on a transferring material (recording medium) that is fed in between the pressurizing roller and the intermediate transfer belt.

Another conventional image forming apparatus including an image transferring and fixing device has been disclosed in Japanese Patent Application Laid-open Publication No. H9-230646 (page 7, FIG. 2). This color image forming apparatus includes a rotating developing unit that has four developing units. Each of the four developing units contains toner of yellow, cyan, magenta, and black colors respectively. The rotating developing unit develops an electrostatic latent image on a photosensitive drum. A developed image, i.e. a toner image, is transferred to the intermediate transfer member in the form of a belt. The toner image is transferred to and fixed on a recording medium via the intermediate transfer member between a heating roller and a facing roller.

Still another conventional image forming apparatus including an image transferring and fixing device has been disclosed in Japanese Patent Application Laid-open Application No. 2001-13798 (pages 3 and 4, FIG. 1). According to this image forming apparatus, a toner image on an image carrier is transferred to an intermediate transfer member in the form of a belt. Before the toner image reaches a fixing nip that is formed by a pressed contact of the heating roller and the pressurizing roller with the intermediate transfer member sandwiched between the two, the toner image is heated through the belt by a sheet heater that is provided on an inner surface side of the intermediate transfer member and functions as an image forming substance integrating unit. Thus the toner image is combined by softening or melting, thereby integrating by binding at least a part of it.

An integrated toner image is transferred to and fixed on the recording medium at the fixing nip.

However, in the image transferring and fixing device disclosed in Japanese. Patent Application Laid-open Publication No. H9-114282, the whole toner image on the intermediate transfer belt is heated by the heating roller to a temperature not lower than a melting temperature of the toner. Therefore, although at least a part of toner particles are integrated by binding, the toner image tends to get deformed easily. When the toner image is pressurized by the pressurizing roller at the fixing nip, the toner tend to be spread along a surface of the recording medium and be deformed along irregularities (ups and downs) of paper fibers on the surface of the recording medium. As a result, there is a big difference in an area of each toner after pressurizing and fixing, resulting in unevenness of graininess and gloss, thereby deteriorating an image quality.

In the image transferring and fixing device disclosed in Japanese Patent Application Laid-open Publication No. H9-230646, no unit has been provided to integrate the toner on the upstream side of the fixing nip that is formed by the pressed contact between the heating roller and the facing roller with the intermediate transfer member sandwiched between the two. Therefore, an image becomes faded if toner particles that form the toner image fall in recesses in the paper fibers on the surface of the recording medium. Further, since heat cannot be transmitted easily to the toner in the recesses, that portion tends to have defective fixing.

Moreover, in the image transferring and fixing device disclosed in the Japanese Patent Application Laid-open Publication No. H9-230646, all the toner that forms the toner image and the recording medium are heated simultaneously to fix the toner image on the recording medium, which reduces the viscosity of each toner. As a result, at a time of fixing, height of toner is changed by 40% to 80% and the area of each toner does not become even due to irregularities on the surface of the recording medium, leading to the deterioration of the image quality.

In other words, as shown in FIG. 10A, even if each toner particle Tn on an intermediate transfer member 61 is deformed roughly in a similar manner (compression deformation), at the time of transferring to and fixing on a paper (transfer paper) P, the toner particles Tn cannot be pressurized evenly due to irregularities (ups and downs) on a surface of the paper P. As shown in FIG. 10B, in a portion in contact with the recesses, an amount of deformation of each toner particle Tn is small and the spreading of the area is small (width W1) because pressure cannot be transmitted easily. Whereas, in a portion in contact with bulges, an amount of pressure exerted being more, there is a big deformation in a direction of width and the area is spread (width W2).

The difference in the area of each toner due to the irregularities on the surface of the paper, as shown by the widths W1 and W2, leads to a deterioration of the graininess of a half-tone image, particularly in a case of a color image. Moreover, that causes a difference in glossiness of the toner image in an area of the recesses and the bulges, resulting in unevenness in gloss, thereby deteriorating the image quality.

Moreover, since the whole toner image is heated, a portion of the toner in contact with the intermediate transfer member is melted and is adhered firmly to the intermediate transfer member. Therefore, in a portion such as a low density portion where an amount of integrated toner is less, sometimes the toner could not be transferred completely to the recording medium.

In the image transferring and fixing device disclosed in Japanese Patent Application Laid-open Publication No. 2001-13798, since there is a unit for integrating the toner image on the intermediate transfer member, the toner cannot be allowed to fall in the recesses on the surface of the recording medium. However, a toner image on an outer surface of the intermediate transfer member in the form of a belt is heated through the belt (intermediate transfer member) both before reaching the fixing nip as well as at the fixing nip. Therefore, when a surface of the toner image that comes in contact with the recording medium is heated up to a required temperature, a portion of the toner that is in contact with the belt is heated to a temperature higher than the required temperature.

The image transferring and fixing devices disclosed in the Japanese Patent Application Laid-open Publication Nos. 2001-13798 and H9-230646 are similar in heating the whole toner image and reducing the viscosity of all the toner. Therefore, at the time of fixing, the height of the toner is changed by about 40% to 80% and there is a difference in the area of each toner due to the irregularities on the surface of the recording medium. As a result of this, the image quality is deteriorated.

SUMMARY OF THE INVENTION

It is an object of the present invention to at least solve the problems in the conventional technology.

The image transferring and fixing device according to an aspect of the present invention includes an integrating unit that integrates an image forming substance on an image carrier by any one of heat and pressure or both; a tackifying unit that tackifies a surface of the integrated image forming substance that comes in contact with a recording medium; and a transferring and fixing unit that transfers to and fixes on the recording medium the image forming substance of which surface is tackified.

The image forming apparatus according to another aspect of the present invention includes an integrating unit that integrates an image forming substance on an image carrier; a tackifying unit that tackifies a surface of the integrated image forming substance that comes in contact with a recording medium; and a transferring and fixing unit that transfers to and fixes on the recording medium the image forming substance of which surface is tackified.

The image transferring and fixing method according to still another aspect of the present invention includes integrating an image forming substance on an image carrier by applying any one of heat and pressure or both; tackifying a surface of the image forming substance integrated that comes in contact with a recording medium; and transferring to and fixing on the recording medium the image forming substance of which surface is tackified.

The other objects, features, and advantages of the present invention are specifically set forth in or will become apparent from the following detailed description of the invention when read in conjunction with the accompanying drawings.

DETAILED DESCRIPTION

Exemplary embodiments of the present invention are described below with reference to accompanying diagrams.

Figure 1:
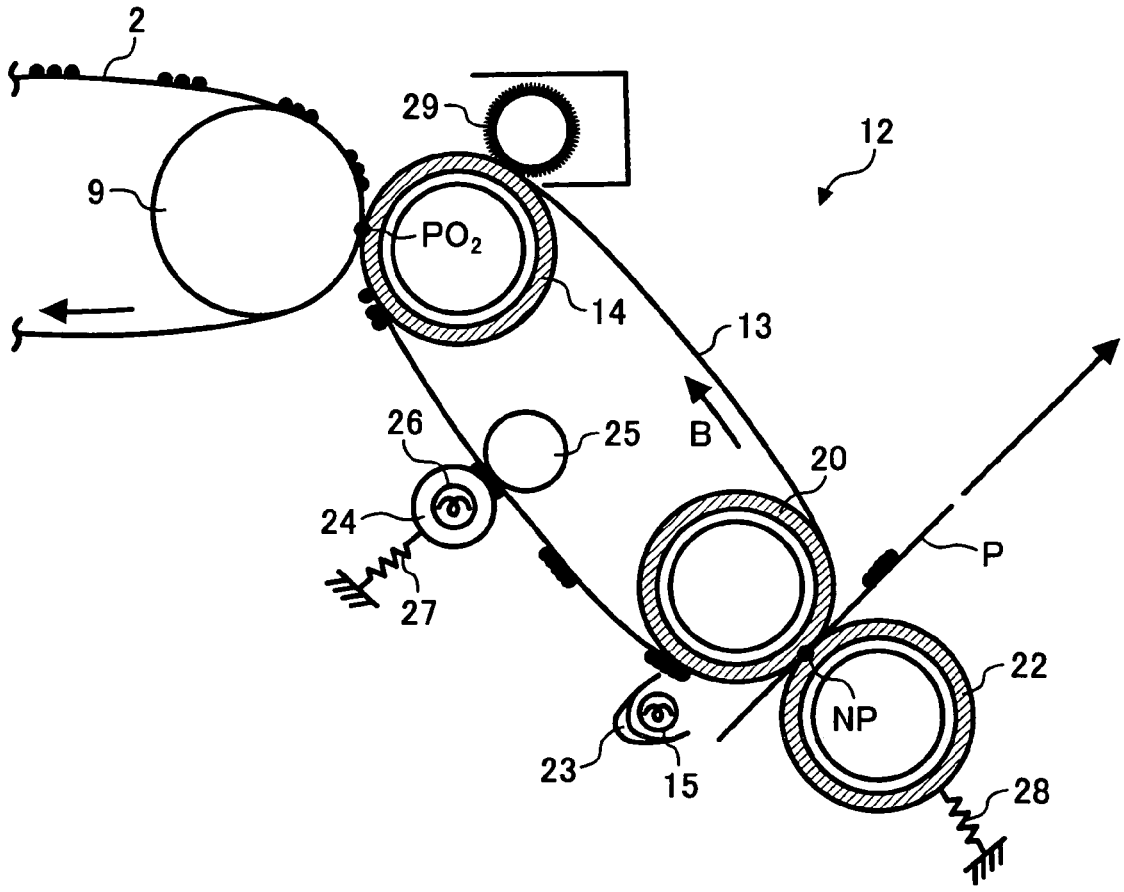
FIG. 1 is a schematic diagram of an image transferring and fixing device according to a first embodiment of the present invention.
Figure 2:
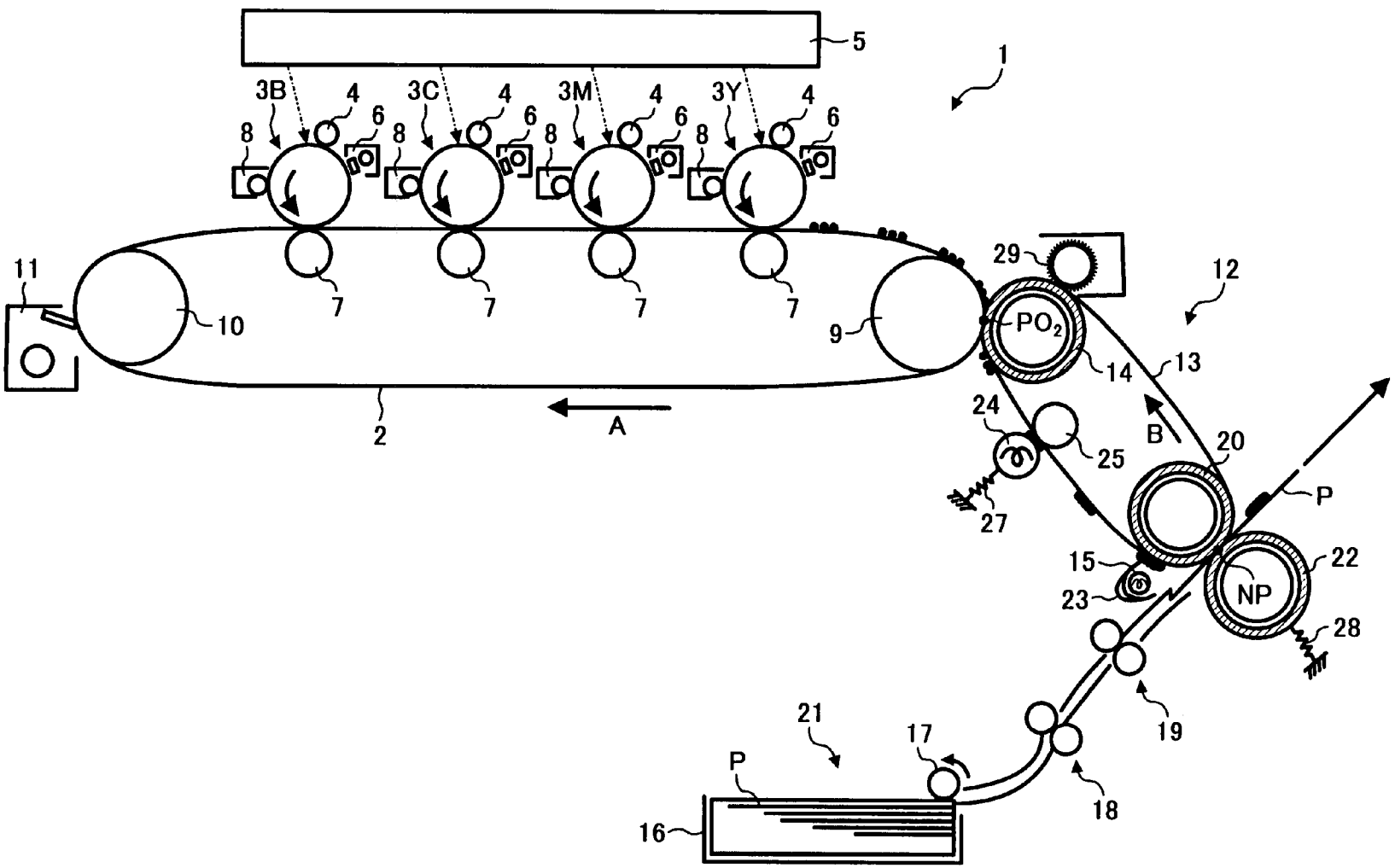
FIG. 2 is a schematic diagram of a main part of an image forming apparatus provided with the image transferring and fixing device.

FIG. 1 is a schematic diagram of an image transferring and fixing device according to a first embodiment of the present invention. FIG. 2 is a schematic diagram of a main part of an image forming apparatus provided with the image transferring and fixing device, in concrete terms, a tandem color copying machine. The tandem color copying machine shown in FIG. 2 includes an image forming section 1 at a center of the machine, a paper feeding section 21 beneath the image forming section 1, and an image reading section that is not shown, above the image forming section 1.

The image forming section 1 includes an intermediate transfer belt 2, a drive roller 9, and a driven roller 10. The intermediate transfer belt 2 has a transferring surface that extends in a horizontal direction. The intermediate transfer belt is stretched over the drive roller 9 and the driven roller 10 and is rotatable in a direction of an arrow A. Photosensitive drums (image carriers) 3Y, 3M, 3C, and 3B (hereinafter, "photosensitive drums 3" when not specified) for yellow, magenta, cyan, and black colors respectively are juxtaposed on a transferring surface of the intermediate transfer belt 2 at intervals along a direction of movement of the intermediate transfer belt 2. Each photosensitive drum 3 forms a latent image on the surface of itself by a toner that is an image forming substance, for respective colors (yellow, magenta, cyan, and black). These colors are complementary colors of the primary colors of light.

Each of the photosensitive drums 3 is rotatable in a same direction (a counterclockwise direction in FIG. 2) and is surrounded by a charging unit 4, a writing unit 5, a developing unit 6, a primary-transfer roller 7, and a cleaning unit 8. These units are used for image forming. A toner of a color corresponding to a color that is developed is stored in each of the developing units 6.

A belt cleaning unit 11 that cleans the surface of the intermediate transfer belt 2 is disposed in a position facing the driven roller 10.

A secondary-transfer roller 14 of an image transferring and fixing device 12 is disposed in a position facing the drive roller 9. The image transferring and fixing device 12 transfers an unfixed toner image on the intermediate transfer belt 2 to a transferring and fixing belt 13, at a secondary-transfer position $PO_2$.

The transferring and fixing belt 13 is an endless belt that is stretched over the secondary-transfer roller 14 and a transferring and fixing roller 20 and is rotatable in a direction of an arrow B. A pressurizing roller 22 is in a pressed contact with the transferring and fixing roller 20 through the transferring and fixing belt 13, thus forming a fixing nip NP.

When an operation of the color copying machine is started, in a case of a full-color image formation, the charging unit 4 charges uniformly a surface of the photosensitive drum 3Y. The writing unit 5 performs optical writing on a charged surface based on image information from the image reading section, and an electrostatic latent image for the yellow color is formed.

The electrostatic latent image is developed by the developing unit 6 that contains yellow toner and becomes a toner image (visualized image). The toner image is subjected to a primary transfer to the intermediate transfer belt 2 by the primary-transfer roller 7 on which a predetermined bias is applied.

Similarly, toner images of respective colors are formed on the photosensitive drums 3M, 3C, and 3B for magenta, cyan, and black colors. The toner image formed on the photosensitive drums 3M, 3C, and 3B are subjected to the primary transfer to the intermediate transfer belt 2 by superimposing the image one after another. Each of the cleaning units 8 removes toner that is remained on each of the photosensitive drums 3 after the primary transfer. After transferring the toner images, a decharging lamp that is not shown in the diagram decharges potential on each of the photosensitive drums 3 and initializes, thereby preparing for a next imaging.

A composite color image (unfixed image) that is subjected to primary transfer by superimposing on the intermediate transfer belt 2, is subjected to a secondary transfer by an electrostatic force, to a side of the transferring and fixing belt 13, at the secondary-transfer position $PO_2$, by a bias that is applied by a secondary bias-applying unit that is not shown, which is disposed between the drive roller 9 and the secondary-transfer roller 14.

On the other hand, a feeding roller 17 of the paper feeding section 21 rotates at a predetermined timing that is matched with the image formation of the image forming section 1 and a paper (recording medium) P is separated one at a time from an upper paper from a bunch in a paper feeding tray 16. The paper P that is fed is carried by a pair of transporting rollers 18 to a pair of registering rollers 19, and stops for a time. A skew is rectified as a front tip of the paper strikes the pair of registering rollers 19 and then the paper is forwarded towards the fixing nip NP at an accurate timing such that it coincides with a front tip of an unfixed image on the transferring and fixing belt 13.

As the paper P is carried to the fixing nip NP, the unfixed image on the transferring and fixing belt 13 comes in a pressed contact and is heated while being pressurized, thereby fixing a toner image. The paper P upon fixing the toner image on it is discharged to a paper discharge tray.

The image transferring and fixing device 12 includes the transferring and fixing belt 13 and a pair of toner integrating rollers 24 and 25. The transferring and fixing belt 13 is an image carrier that holds toner (that is an image forming substance and is shown by filled-in circle in FIG. 1) in the form of powder particles as shown in FIG. 1. The pair of the toner integrating rollers 24 and 25 functions as an image forming substance integrating unit that integrates by binding at least a part of the toner on the transferring and fixing belt 13. The unfixed toner image that is integrated by the pair of the toner integrating rollers 24 and 25 is transferred to and fixed on the paper that is a recording medium, at the fixing nip NP which is a transferring and fixing section.

The image transferring and fixing device 12 includes a halogen heater 15 and a reflecting mirror 23 on an upstream side of a direction of movement of a belt of the fixing nip NP. The halogen heater 15 functions as a tackifying unit that imparts tackiness to a surface of the unfixed toner image that is integrated by the toner integrating rollers 24 and 25, which comes in contact with the paper P. Light radiated from the halogen heater 15 is focused by the reflecting mirror 23 and allowed to fall on the toner integrated on the transferring and fixing belt 13, thereby heating the toner efficiently.

Thus, according to the first embodiment, the halogen heater 15, which is a radiation-heating unit that imparts tackiness to the toner by radiant heat, is used as a tackifying member. The halogen heater 15 is provided on an outer side of the transferring and fixing belt 13.

A focusing width in a direction of movement of the belt of the tackifying member is set to a value in a range of radiation time from 1 msec to a few tens of msec from a process speed. The radiation heating of the toner is carried out near the fixing nip NP as shown in FIG. 1.

The transferring and fixing belt 13 has a two-layered structure. A base layer on an inner side includes a polyimide resin. An outer layer on an outer side that is a release layer for improving a toner release ability is a 10 μm to 30 μm thick layer of PFA (tetrafluoroethylene perfluoroalkylvinylether copolymer resin) and PTFE (tetrafluoroethylene copolymer resin), which are fluorine contained resin materials.

The transferring and fixing belt 13 may as well be provided with a 0.05 mm to 0.5 mm thick heat-resistant elastic layer that includes materials such as silicon rubber, as an intermediate layer. Such an intermediate layer enables to make a pressure on the toner roughly uniform, while integrating the toner and while transferring and fixing.

Moreover, another way of improving the release ability of the surface of the transferring and fixing belt 13 is to apply oil for releasing the toner, on the surface of the transferring and fixing belt 13.

The toner integrating rollers 24 and 25 may be such that at least a part of toner particles is integrated by binding by a pressure that is exerted by a pressed contact between the two rollers. The toner integrating rollers 24 and 25 may as well be rollers that integrate toner by pressure and heat as shown in FIG. 1.

In a case of integrating the toner only by pressure, a bearing stress of the toner integrating rollers 24 and 25 is let to be about 10 $kgf/cm^2$ to 50 $kgf/cm^2$. An unfixed toner image is fed between these rollers and integrated. In this case, the toner integrating rollers 24 and 25 may include a chrome plated core of a metal or may have a 0.1 mm to 0.5 mm thick silicon rubber layer as an outer layer with a coating of a fluorine-contained resin on it.

In a case of integrating the toner by pressure and heat as shown in FIG. 1, a halogen heater 26 is provided inside the toner integrating roller 24 and the toner integrating roller 24 is heated to a predetermined temperature. In this case, as compared to the case of integrating the toner by pressure only, the bearing stress required can be reduced to 0.5 $kgf/cm^2$ to 5 $kgf/cm^2$. When the pressure and the heat are to be applied together, due to melting of the toner by heat, the binding of the toner can be improved. The toner can be integrated uniformly.

The melting condition of toner can be changed by controlling a heating temperature of the toner integrating roller 24 by controlling an electric power to the halogen heater 26. By doing so, a gloss of the toner can be controlled. Furthermore, a toner that includes wax is used in this color copying machine. Therefore, the wax can be allowed to be eluted from an outer layer of the toner, thereby improving the release ability. By using the toner that includes wax, the release ability of the toner from the transferring and fixing belt 13 improves, thereby improving the transferring efficiency.

The toner integrating roller 25 from the pair of the toner integrating rollers 24 and 25 is fixed and a shaft of the toner integrating roller 25 is rotatably supported by a fixed bearing. The toner integrating roller 24 is a movable roller and a bearing that rotatably supports a shaft of the toner integrating roller 24 is supported such that it can go closer to as well as can go away from the toner integrating roller 25. The bearing of the toner integrating roller 24 is pushed and biased by a pressurizing spring 27 and the toner integrating roller 24 is in a pressed contact with the toner integrating roller 25 with the transferring and fixing belt 13 sandwiched between the two.

The pressurizing roller 22 is pushed and biased by a pressurizing spring 28 and is in pressed contact with the transferring and fixing roller 20 with the transferring and fixing belt 13 sandwiched between the two. The pressed contact has a welding pressure suitable for fixing. Thus, the fixing nip NP of an ideal width is formed.

A cleaning roller 29 is provided on a downstream side in a direction of movement of a belt of the fixing nip NP, which is an upstream side of the secondary-transfer position $PO_2$. The cleaning roller 29 includes a metal roller with a felt wound over a surface of the metal roller. The cleaning roller 29 removes toner remained after transferring and fixing that has passed through the fixing nip NP.

Normal black color toner is useful for radiation heating as it has an excellent optical absorptivity. On the other hand, toners of other colors yellow, magenta, and cyan have poor optical absorptivity as compared to that of the black color toner. Therefore, an infrared absorbent is included in these color toners so that the color toners have a similar efficiency of heating by radiation as that of the black color toner.

In this color copying machine, as described by referring to FIG. 2, the toner image of each color is formed on each of the photosensitive drums 3 by an electrophotography and the toner images of different colors are transferred by superimposing one after another on the intermediate transfer belt 2. The toner images transferred to the intermediate transfer belt 2 are transferred to the transferring and fixing belt 13 at the secondary-transfer position $PO_2$. As the transferring and fixing belt 13 moves in the direction of the arrow B in FIG. 1, the toner images are forwarded between the toner integrating rollers 24 and 25. The toner images are pressurized (and also heated in this embodiment) between the toner integrating rollers 24 and 25 and the toner particles are integrated by binding (shown in a black rectangle in FIG. 1).

As the toner that is integrated moves to a position near the fixing nip NP by the movement of the transferring and fixing belt 13 in the direction of the arrow B, a surface of the toner facing the halogen heater 15 is heated by radiation from the halogen heater 15.

At this time, an irradiated interface of the toner being heated rapidly to a temperature of about 120° C. to 200° C., the surface facing the halogen heater 15 becomes tacky. However, an interface in contact with the transferring and fixing belt 13 and the toner near this interface not being heated, the viscosity of the toner in this portion is less. Thus, in the image transferring and fixing device 12, before the fixing nip NP, there is a temperature difference of 20 degrees to 50 degrees between the surface of the toner that is heated by radiation and the surface that is in contact with the transferring and fixing belt 13.

With the difference in the temperature of the surface and of the inside of the toner, the toner that is integrated is carried to the fixing nip NP and comes in a pressed contact with the paper P that is fed to the fixing nip NP. Thus, the toner integrated is transferred to and fixed on the paper P. The paper P with the toner fixed on it is then discharged to the paper discharge tray.

Thus, in the image transferring and fixing device 12 according to the first embodiment, the toner image transferred to the transferring and fixing belt 13 is combined and integrated by the toner integrating rollers 24 and 25. Therefore, toner particles do not fall in recesses caused due to paper fibers on a surface of the paper P. For this reason, there is no portion in which the heat cannot be transmitted to the toner easily, thereby enabling to prevent defective fixing, and fading of the image.

Moreover, by radiation-heating by the halogen heater 15, heat is imparted only to an outer layer portion of the toner integrated that comes in contact with the paper P, and the tackiness of the toner only in this outer layer portion is improved to allow it to fix easily on the paper P. A viscosity on the inside of the toner image and the interface that is in contact with the transferring and fixing belt 13, which are not radiated, is allowed to be declined by a small extent. Therefore, when the toner image is pressurized on the paper P at the fixing nip NP, an amount of deformation of the overall toner is less. As a result of this, an amount of change in a height of the toner after the deformation is not greater than 40% as it was before the transferring and fixing.

The conventional image transferring and fixing device in which the toner is transferred to and fixed on a paper after reducing the viscosity of it by heating the overall toner (not only the surface of the toner image but also the inside of the toner image), the height of the toner is changed to about 40% to 80% before and after the transferring and fixing of the toner. Since the amount of deformation is big, due to irregularities (ups and downs) of the paper fibers on the surface of the paper, there is a difference in spreading of an area of the toner after pressurizing. An image quality is deteriorated due to an increase in a difference in the area of the toner. In the image transferring and fixing device 12 according to the first embodiment, the spreading of the area at the time of transferring and fixing of the toner image decreases (dot gain is small), thereby enabling to achieve good fixity and prevent the deterioration of the image quality.

Thus, by using the image transferring and fixing device 12 shown in FIG. 1, while transferring to and fixing on the paper P the toner in the form of the powder particles that is held on the transferring and fixing belt 13, the toner is integrated both by the heat and the pressure (both or any of the two may be used). The tackiness is imparted to the surface of the toner that comes in contact with the paper by radiation heating by the halogen heater 15 and the reflecting mirror 23. Then an image transferring and fixing method is performed to transfer and fix this toner to give the desired effect.

Figure 3:
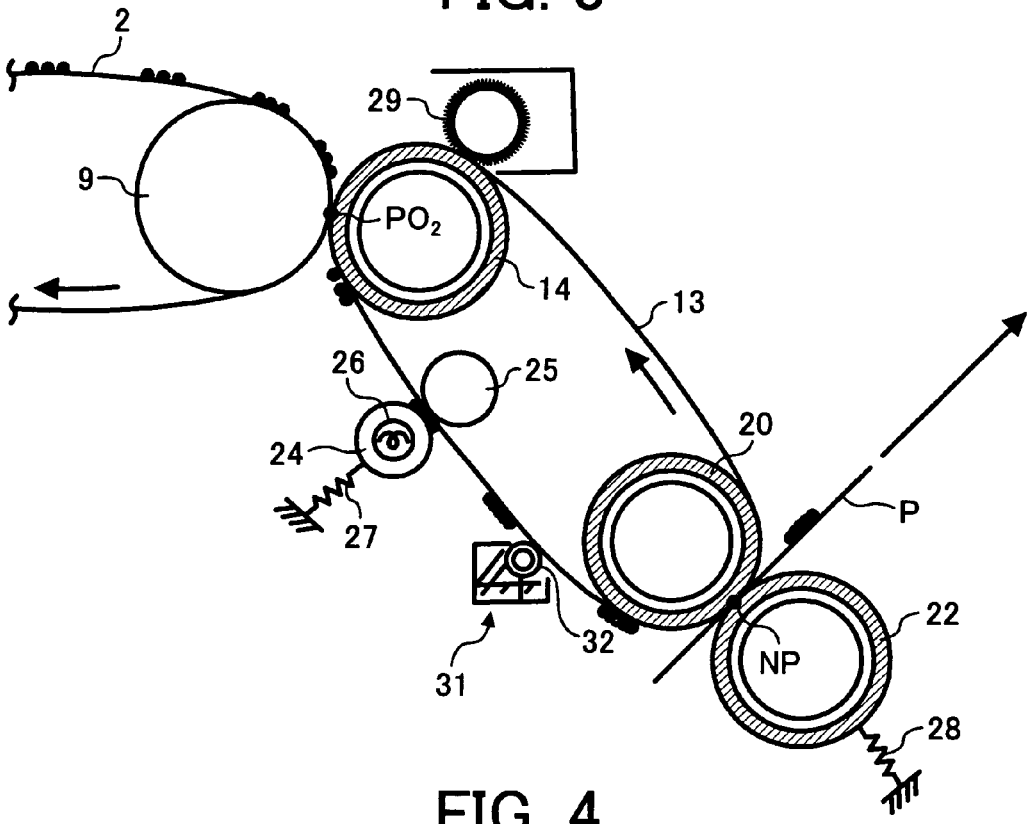
FIG. 3 is a schematic diagram of an image transferring and fixing device according to a second embodiment of the present invention.

FIG. 3 is a schematic diagram of an image transferring and fixing device in an image forming apparatus according to a second embodiment of the present invention. Same reference numerals are used for components similar to that in FIG. 1. Except for a tackifying unit that is different from the one in the first embodiment, a structure of the image transferring and fixing device according to the second embodiment is similar to that of the image transferring and fixing device according to the first embodiment. Therefore, a diagram of the image forming apparatus is omitted.

The only point of difference according to the second embodiment from the first embodiment is that the image transferring and fixing device includes an applying unit 31 that applies a fixing-assisting agent, as a tackifying unit that imparts tackiness to the surface of the toner (interface of the toner) that comes in contact with the paper P. Therefore, even in the second embodiment, the toner integrating rollers 24 and 25 are provided. The applying unit 31 is disposed on an upstream side of the fixing nip NP at the downstream side in a direction of movement of the belt of the toner integrating rollers 24 and 25.

The applying unit 31 includes an applying roller 32 that has a metal roller on a surface of which a felt is wound. An organic ester dispersing solution that is a fixing-assisting agent is allowed to be circulated and adhered on the applying roller 32. The applying roller 32 that has the fixing-assisting agent adhered to it applies the fixing-assisting agent uniformly on a side of a surface of the toner on the transferring and fixing belt 13, that comes in contact with the paper P.

According to the second embodiment, the unfixed toner image on the transferring and fixing belt 13 is integrated by the toner integrating rollers 24 and 25 similarly as according to the first embodiment. The applying roller 32 applies the fixing-assisting agent uniformly on the side of the surface of the toner that comes in contact with the paper P. Due to applying of the fixing-assisting agent, the surface of the toner that comes in contact with the paper P is melted and has tackiness.

The toner with the tackiness comes in a press contact with the paper P that is carried up to the fixing nip NP. As a result of this, the toner that is integrated and has improved tackiness is transferred to and fixed on the paper P. After the toner is fixed, the paper P is discharged to the paper discharge tray.

According to the second embodiment, only the surface side of the toner that comes in contact with the paper P is allowed to have tackiness similarly as according to the first embodiment. Therefore, the deformation (height in a direction of compression) of the toner at the time of fixing by pressurizing is small as compared to a case where the tackiness is imparted to the overall toner (including a surface that comes in contact with the transferring and fixing belt 13). This enables to reduce the difference in the area of the toner image at the time of fixing by pressurizing, thereby preventing the deterioration of the image quality.

Since the tackiness is not imparted by heat energy as in the first embodiment, energy can be saved.

According to the second embodiment, the fixing-assisting agent is applied to the toner image that is integrated on the transferring and fixing belt 13 by the applying roller 32. Therefore, as compared to a case in which the fixing-assisting agent is sprayed or applied on a toner in the form of a powder before integrating, it is possible to prevent scattering of the fixing-assisting agent and an offset on an applying member.

An organic resin-dispersing liquid of low molecular weight that includes an infrared absorbent may be used as the fixing-assisting agent. This fixing-assisting agent may be applied on the toner image that is integrated on the transferring and fixing belt 13. The toner image may be subjected to radiation heating by the halogen heater 15 described in the first embodiment to melt the organic resin-dispersing liquid of low molecular weight and to impart tackiness. The toner image with the improved tackiness may be transferred to and fixed on the paper P at the fixing nip NP.

Figure 4:
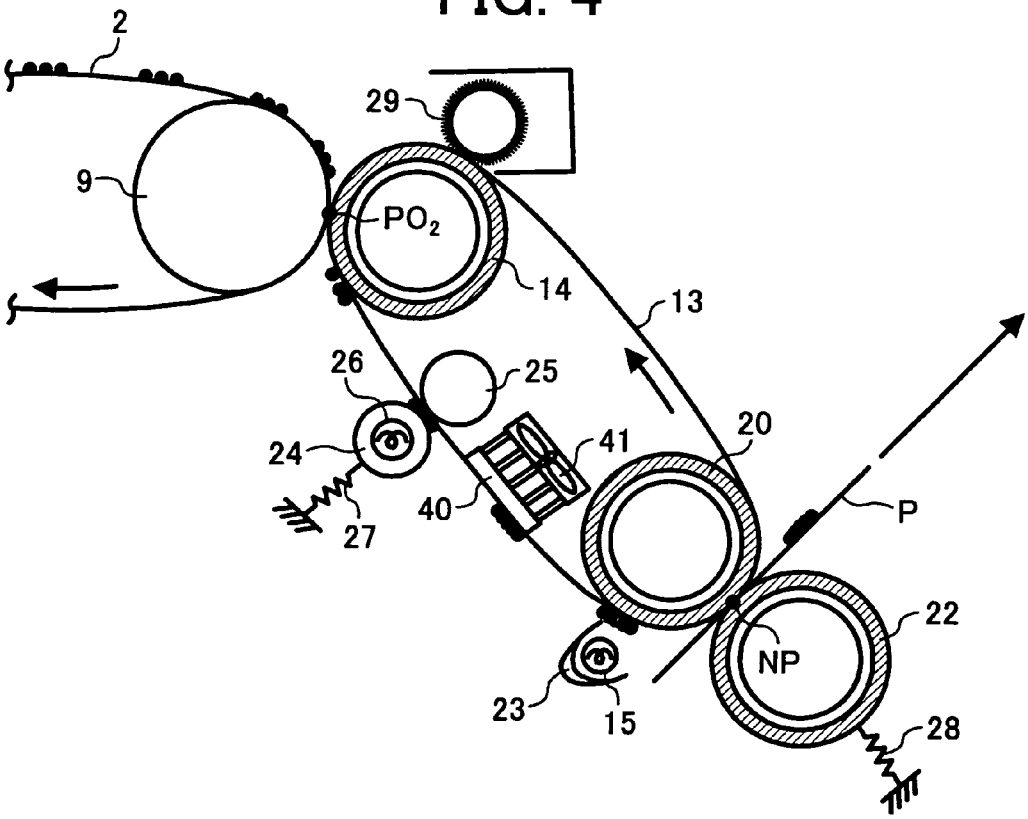
FIG. 4 is a schematic diagram of an image transferring and fixing device according to a third embodiment of the present invention.

FIG. 4 is a schematic diagram of an image transferring and fixing device in an image forming apparatus according to a third embodiment of the present invention. Same reference numerals are used for components similar to that in FIG. 1. The image transferring and fixing device according to the third embodiment includes a cooling unit which is the only point of difference between the third embodiment and the first embodiment. The cooling unit includes a cooling fan 40 and a fan 41 that cool the toner image that is integrated on the transferring and fixing belt 13. The cooling unit is provided between the pair of the toner integrating rollers 24 and 25, which is an image forming substance integrating unit and the fixing nip NP, which is the transferring and fixing section. The rest of the structure is similar to that according to the first embodiment hence a diagram of the image forming apparatus is omitted.

According to the third embodiment, the cooling unit that is provided on a downstream side of the toner integrating rollers 24 and 25 in the direction of movement of the belt includes the cooling fan 40, which is provided such that it comes in contact with an inner side of the transferring and fixing belt 13. The cooling fan 40 is cooled by blowing of air by the fan 41. Similarly as according to the first embodiment, the halogen heater 15 and the reflecting mirror 23 are provided on a downstream side of the cooling unit in a direction of movement of a belt.

In the image transferring and fixing device according to the third embodiment, toner that is electrostatically transferred to the transferring and fixing belt 13 is integrated by pressurizing and heating by the toner integrating rollers 24 and 25. As the toner integrated is moved up to a position of the cooling fan 40 by the movement of the transferring and fixing belt 13, the cooling fan 40 that is cooled by the fan 41 cools it down by taking off heat from the side that is in contact with the transferring and fixing belt 13.

As the toner that is cooled is moved up to the halogen heater 15 by the movement of the transferring and fixing belt 13, the side of the surface that comes in contact (toner interface) with the paper P is heated by radiation from the halogen heater 15. As the halogen heater 15 heats the toner rapidly to a high temperature in a short time, there is big temperature difference occurring rapidly between the side of the surface of the toner integrated that is subjected to radiation heating and the side of the surface that comes in contact with the transferring and fixing belt 13.

Therefore, only the surface the toner that is integrated on the transferring and fixing belt 13 that is subjected to radiation heating is melted and becomes tacky on the side of the surface only and there is no big change in viscosity from the inside of the toner up to the side of the transferring and fixing belt 13.

In this condition, since the tacky side of the surface of the toner integrated, makes a pressed contact with the paper P at the fixing nip NP, it is fixed assuredly. At this time, the change in the viscosity from the inside of the toner up to the side of the transferring and fixing belt 13 being small, even if it is pressurized at the fixing nip NP, the amount of deformation of the overall toner is small. Therefore, there is a small difference in the area of the toner image at the time of fixing, which enables to achieve a good image.

Moreover, in the image transferring and fixing device according to the third embodiment, even though the toner is integrated by heat and pressure by the toner integrating rollers 24 and 25, since the toner is cooled down immediately, the difference in temperature between the side of the surface of the toner that is subjected to radiation heating by the halogen heater 15 and the side that comes in contact with the transferring and fixing belt 13 can be let to be even more than that according to the first embodiment.

For this reason, it is possible to suppress a decrease in viscosity of the toner as a whole and to reduce the difference in the area of the toner image corresponding to the irregularities due to paper fibers on the surface of the paper P, thereby enabling to prevent the deterioration of the image quality.

Moreover, since a toner temperature of the toner at an interface of the toner and the transferring and fixing belt 13 is lowered forcibly by the cooling fan 40 and the fan 41, the tackiness of the interface of the transferring and fixing belt 13 and the toner becomes less and the ability to release of the toner with respect to the transferring and fixing belt 13 improves. Therefore, it is possible to deal with a high speed as well.

Thus, for transferring to and fixing on the paper P, the toner in the form of powder particles that is transferred to the transferring and fixing belt 13 is integrated both by the heat energy and the pressure (or may be by any one of the two). After integrating the toner, the surface of the toner on the surface of the side of the transferring and fixing belt 13 is cooled down. The side of the surface of the toner that comes in contact with the paper P is heated and then the toner is transferred and fixed. If such a method of transferring and fixing the toner is used, the desired effect can be achieved.

Figure 5:
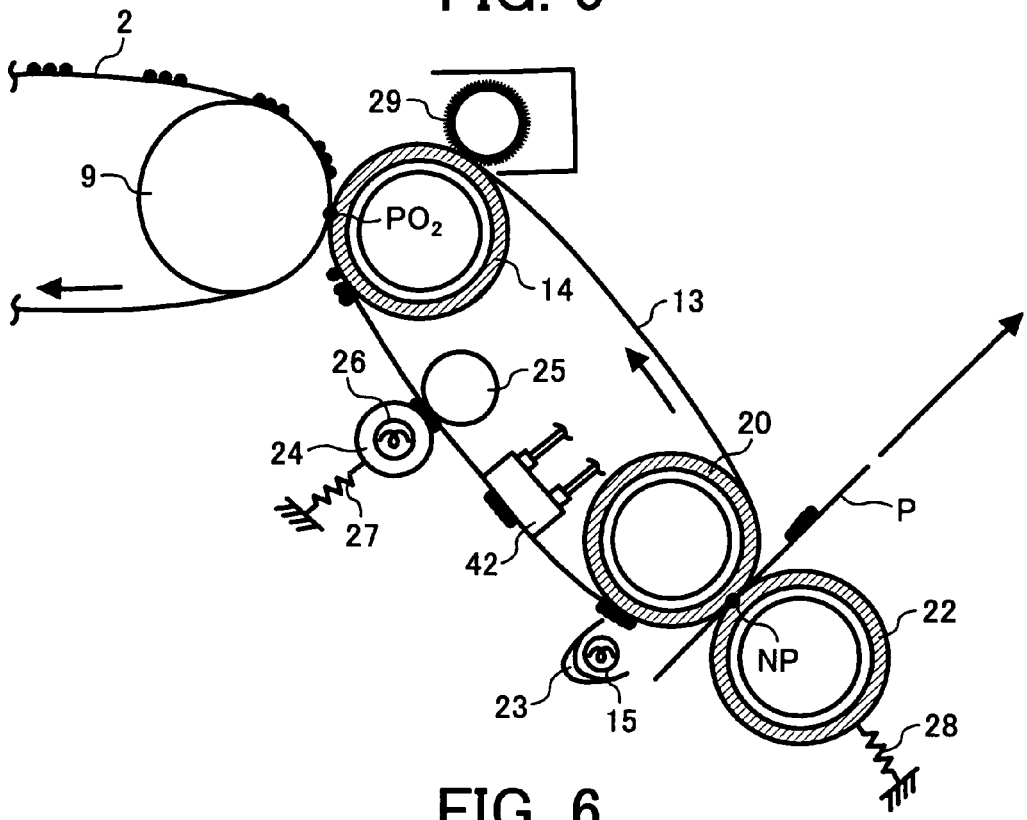
FIG. 5 is a schematic diagram of an image transferring and fixing device according to a fourth embodiment of the present invention.

FIG. 5 is a schematic diagram of an image transferring and fixing device in an image forming apparatus according to a fourth embodiment of the present invention. Same reference numerals are used for components similar to that in FIGS. 1 and 4. The image transferring and fixing device according to the fourth embodiment is provided with a cooling unit that has a structure different from that of the cooling unit described by referring to FIG. 4 according to the third embodiment. This is the only point of difference. The rest of the structure being similar, a diagram of the image forming apparatus is omitted.

According to the fourth embodiment, the image transferring and fixing device is provided with the cooling unit that cools down a water-cooled block 42 by circulating cooling water by a cooling water circulating pump instead of using the cooling fan 40 and the fan 41 as shown in FIG. 4.

Even if the image transferring and fixing device is structured in such a manner, the temperature of the toner image on the side that is in contact with the transferring and fixing belt 13, after the toner is integrated by the toner integrating rollers 24 and 25 on the transferring and fixing belt 13, can be lowered forcibly by the water-cooled block 42. This enables to achieve an effect similar to that described in the third embodiment.

Figure 6:
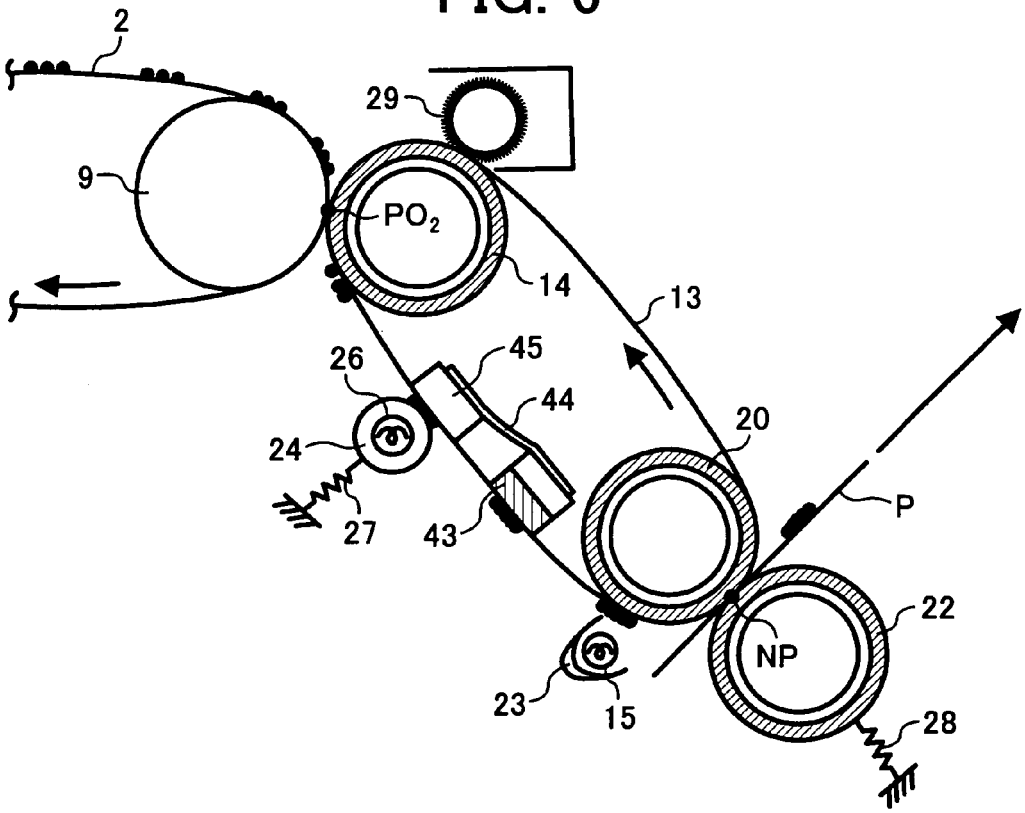
FIG. 6 is a schematic diagram of an image transferring and fixing device according to a fifth embodiment of the present invention.

FIG. 6 is a schematic diagram of an image transferring and fixing device in an image forming apparatus according to a fifth embodiment of the present invention. Same reference numerals are used for components similar to that in FIGS. 1 and 4. The image transferring and fixing device according to the fifth embodiment is provided with a cooling unit that has a structure different from that of the cooling units according the third and the fourth embodiments and an image forming substance integrating unit that uses a toner integrating member 45 in the form of a block. These are the only points of difference between the fifth embodiment and the third and the fourth embodiments. The rest of the structure being similar, a diagram of the image forming apparatus is omitted.

According to the fifth embodiment, the image transferring and fixing device includes the toner integrating roller 24, the toner integrating member 45, and a Peltier element 43. The toner integrating roller 24 is an image forming substance integrating unit. The toner integrating member 45 faces the toner integrating roller 24 and makes a contact with it with the transferring and fixing belt 13 sandwiched between the two. The Peltier element 43 functions as a cooling unit and is disposed on a downstream side of the direction of motion of the belt. The Peltier element 43 and the toner integrating member 45 are linked by a heat pipe 44.

The Peltier element 43 is in contact with the transferring and fixing belt 13. The Peltier element 43 cools down the transferring and fixing belt 13 from an inner side and cools down the side of the surface of the toner integrated on the transferring and fixing belt 13, that is in contact with the transferring and fixing belt 13. A heat releasing side of the Peltier element 43 is connected to the toner integrating member 45 by the heat pipe 44. Due to this, a toner image that is sandwiched between the toner integrating roller 24 and the toner integrating member 45 via the transferring and fixing belt 13 is integrated by pressurizing while being heated.

Thus, even if the image forming substance integrating unit and the cooling unit are provided, the temperature of the side of the toner image that is in contact with the transferring and fixing belt 13 after the toner that is integrated by the toner integrating roller 24 and the toner integrating member 45 on the transferring and fixing belt, can be lowered forcibly by the Peltier element 43. This enables to achieve an effect similar to that described in the third and the fourth embodiments.

According to the fifth embodiment, heat that is discharged during the cooling is circulated and is used as a source of heat for integrating the toner. Therefore, the cooling and heating can be performed efficiently.

Figure 7:
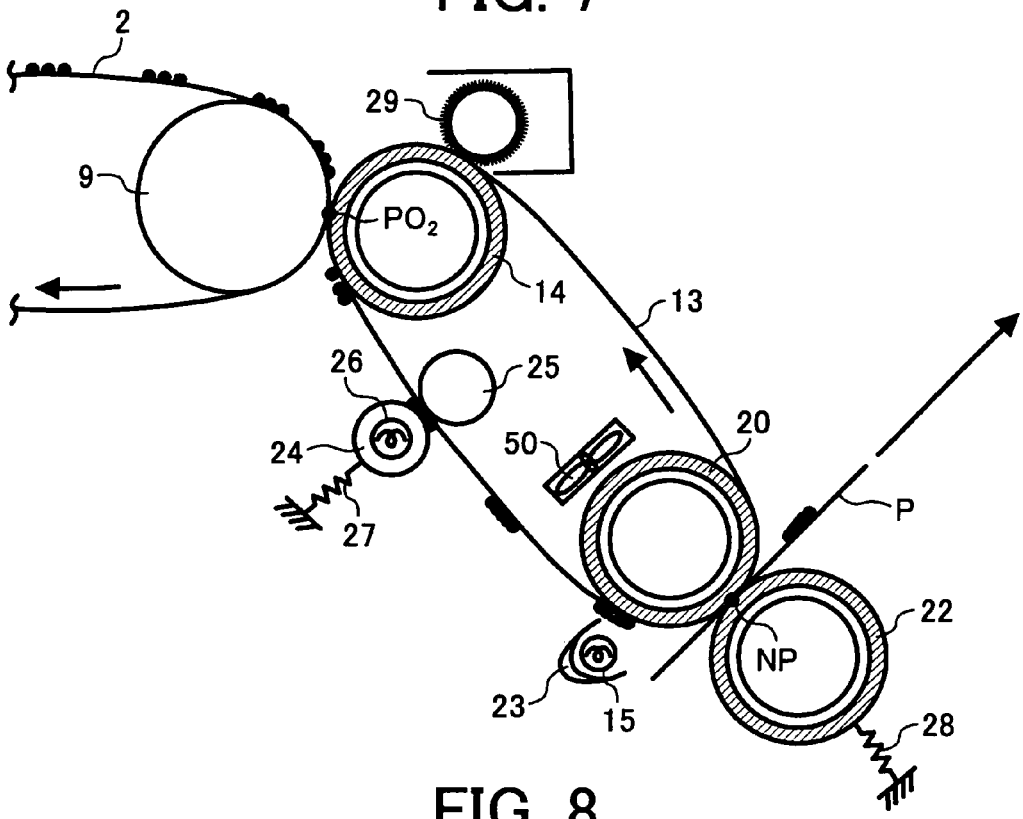
FIG. 7 is a schematic diagram of an image transferring and fixing device according to a sixth embodiment of the present invention.

FIG. 7 is a schematic diagram of an image transferring and fixing device in an image forming apparatus according to a sixth embodiment of the present invention. Same reference numerals are used for components similar to that in FIGS. 1 and 4. In the image transferring and fixing device according to the sixth embodiment, the toner image that is integrated on the transferring and fixing belt 13 is cooled down at the fixing nip NP and just before the fixing nip NP by cooling the transferring and fixing roller by the cooling unit. This is the only point of difference between the sixth embodiment and the fourth embodiment. The rest of the structure being similar, a diagram of the image forming apparatus is omitted.

According to the sixth embodiment, the image transferring and fixing device is structured such that a fan 50 cools down a transferring and fixing nip NP that is formed by the pressurizing roller 22 and the transferring and fixing roller 20. Thus, if the transferring and fixing roller 20 is cooled down by an air blow from the fan 50, the toner image on the transferring and fixing belt 13 that has reached a position where it comes in contact with the transferring and fixing roller 20 via the transferring and fixing belt 13, before the transferring and fixing nip NP, is cooled from a side of an interface in contact with the belt via the transferring and fixing belt 13.

By doing so, together with the cooling of the interface of the toner image that is in contact with the transferring and fixing belt 13, the side of the surface of the toner image that is in contact with the paper P is subjected to radiation heating by the halogen heater 15 that is a heating unit, to a temperature not less than a glass-transition temperature, and the toner image can be transferred and fixed.

Therefore, for the toner image upon being integrated on the transferring and fixing belt 13, a big difference in temperatures of the surface on an outer side that is subjected to radiation heating and of the interface that is in contact with the transferring and fixing belt 13 can be caused. Thus, it is possible to create a big difference in temperature in the toner image as compared to the embodiments described by referring to FIGS. 4 and 6. This improves the release ability of the toner image with respect to the transferring and fixing belt 13.

Figure 8:
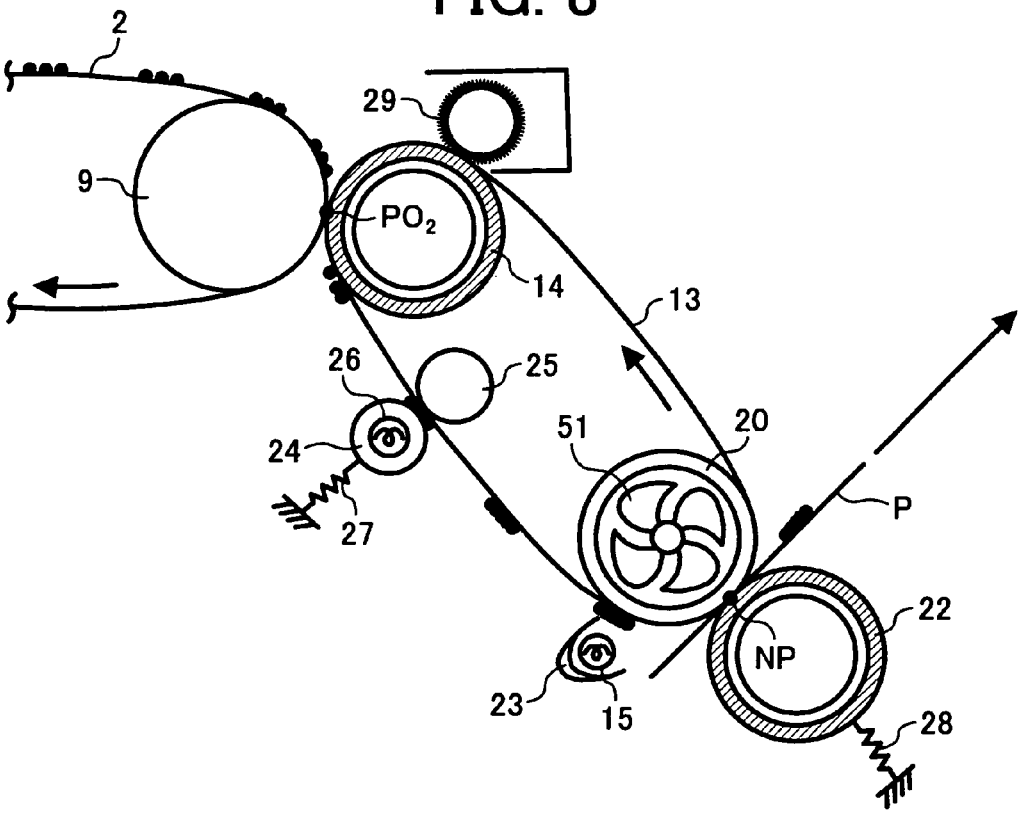
FIG. 8 is a schematic diagram of an image transferring and fixing device according to a seventh embodiment of the present invention.

FIG. 8 is a schematic diagram of an image transferring and fixing device in an image forming apparatus according to a seventh embodiment of the present invention. Same reference numerals are used for components similar to that in FIGS. 1 and 7. In the image transferring and fixing device according to the seventh embodiment, a cooling unit is structured such that outside air is allowed to pass through the transferring and fixing roller 20. This is the only point of difference between the seventh embodiment and the sixth embodiment described by referring to FIG. 7. The rest of the structure being similar, a diagram of the image forming apparatus is omitted.

According to the seventh embodiment, as a fan 51 is rotated, the outside air is passed through the transferring and fixing roller 20 and the transferring and fixing roller 20 is cooled down from the inner side. Thus, an effect similar to that according to the sixth embodiment is achieved.

Figure 9:
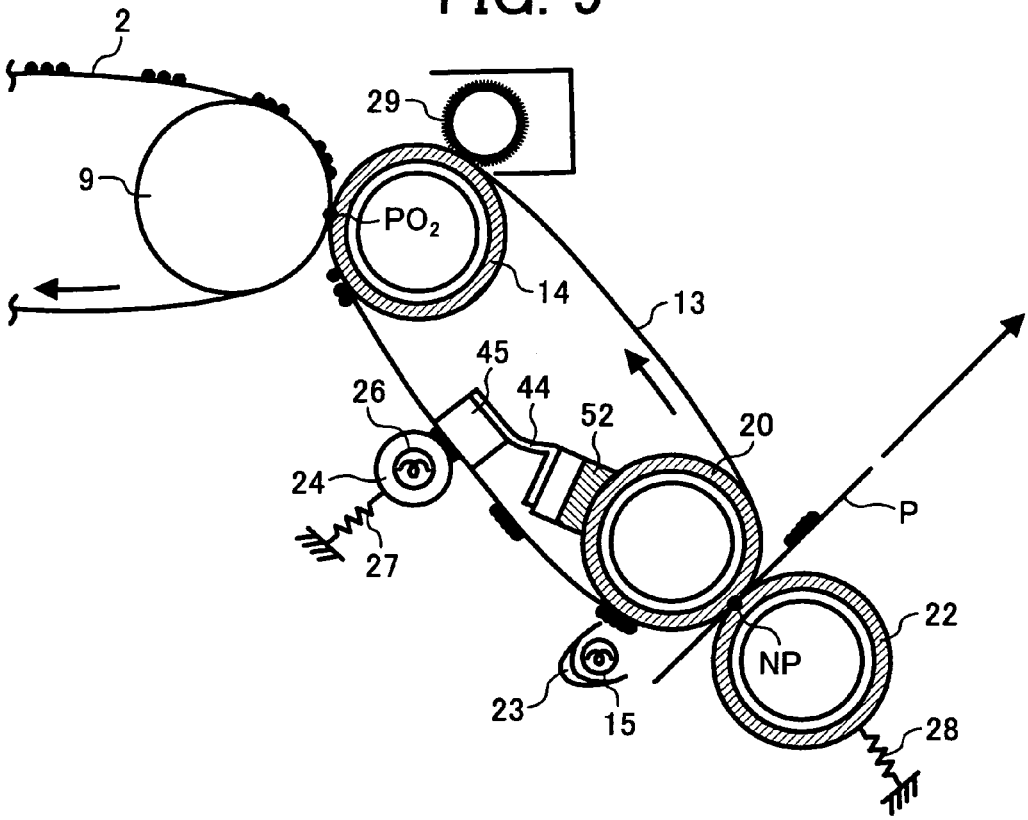
FIG. 9 is a schematic diagram of an image transferring and fixing device according to a eighth embodiment of the present invention.
Figure 10A:
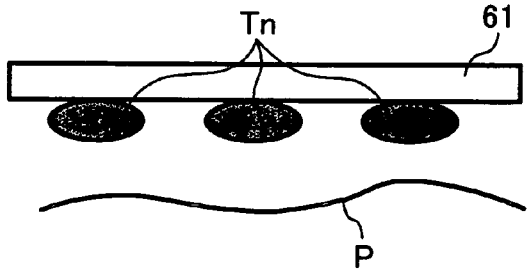
FIGS. 10A and 10B are schematics for explaining a difference in deformation of toner particles due to irregularities on a surface of a paper.
Figure 10B:
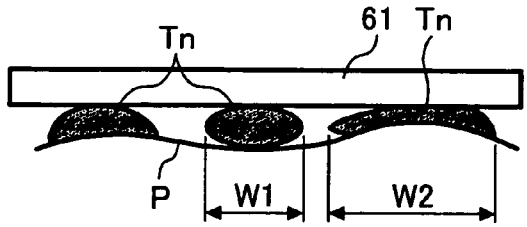

FIG. 9 is a schematic diagram of an image transferring and fixing device in an image forming apparatus according to an eighth embodiment of the present invention. Same reference numerals are used for components similar to that in FIGS. 1 and 6. In the image transferring and fixing device according to the eighth embodiment, a Peltier element 52, which is a cooling unit, cools down the image transferring and fixing roller 20. This is the only point of difference between the eighth embodiment and the first and the sixth embodiments. The rest of the structure being similar, a diagram of the image forming apparatus is omitted.

According to the eighth embodiment, toner, which is an image forming substance, has a resin as a principal component that includes wax. The Peltier element 52 that functions as a cooling unit is provided such that it scrapes a surface of the transferring and fixing roller 20. A temperature of the interface of the transferring and fixing belt 13 with the toner image (unfixed image) that is integrated by the toner integrating roller 24 and the toner integrating member 45 on the transferring and fixing belt 13 is let to be not less than 60° C., which is a melting temperature of the wax. The toner image is transferred and fixed by controlling the temperature to a temperature not greater than 80° C., which is a glass-transition temperature of the resin.

The temperature of the interface of the toner image is detected by a temperature sensor provided in a position such as inside of the transferring and fixing belt 13, which is not shown in the diagram.

By doing so, the tackiness at the interface of the toner and the transferring and fixing belt 13 is eliminated by controlling the temperature of the resin which is the main component of the toner, to the temperature not higher than the glass-transition temperature, and the wax is melted. By removing the tackiness and causing the wax to melt, the release ability of the toner with respect to the transferring and fixing belt 13 is improved, thereby improving the efficiency of image transferring to and fixing on the paper P.

According to the eighth embodiment, similarly as according to the fifth embodiment, heat discharged from the Peltier element 52 is circulated to the toner integrating member 45 through the heat pipe 44. Therefore, by using the discharged heat as a source of heat for integrating the toner, the cooling and the heating can be performed effectively.

In the image transferring and fixing devices according to the embodiments above, the endless transferring and fixing belt is used to hold the unfixed toner image. By using such a belt, a degree of freedom of a layout is improved. Moreover, in a case of a roller, if the forming image substance integrating unit and the cooling unit are provided, there is an increase in a roller diameter. In a case of the belt, it is advantageous from a space point of view.

According to the present invention, an image forming substance on an image carrier is integrated by binding by an image forming substance integrating unit. Therefore, since the image forming substance can be prevented from falling in small recesses on a surface of a recording medium, heat is transmitted sufficiently to the whole image forming substance that is to be fixed, thereby enabling to prevent defective fixing and fading of an image.

Moreover, a tackifying unit imparts tackiness to the surface of the image forming substance that is integrated, which is in contact with the recording medium, thereby allowing the image forming substance to be fixed on the recording medium. This enables fixing even if a portion from a surface of contact of the image forming substance with the recording medium up to a surface of contact of the image forming substance with the image carrier is not heated. Therefore, it is possible to lower a temperature of a side of the image forming substance that is in contact with the image carrier (affecting the tackiness) as compared to a temperature of the surface that is in contact with the recording medium. By doing so, the image forming substance cannot be deformed easily due to the irregularities on the surface of the recording medium and there is a small difference in the spreading of the area at the time of transferring and fixing, thereby enabling to have a good image quality.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image transferring and fixing device comprising:

an integrating unit that integrates an image forming substance on an image carrier by applying any one of heat and pressure or both;

a cooling unit configured to cool the image forming substance;

a tackifying unit that tackifies a surface of the image forming substance integrated that comes in contact with a recording medium; and a transferring and fixing unit that transfers to and fixes on the recording medium the image forming substance of which surface is tackified.

2. The image transferring and fixing device according to claim 1, wherein the tackifying unit tackifies the surface by heat.

3. The image transferring and fixing device according to claim 1, wherein the cooling unit is disposed between the integrating unit and the transferring and fixing unit.

4. The image transferring and fixing device according to claim 1, wherein the image carrier is an endless belt.

5. The image transferring and fixing device according to claim 1, wherein the image forming substance is a toner that includes wax.

6. The image transferring and fixing device according to claim 1, wherein the image forming substance includes resin, wherein the cooling unit cools the resin so that a temperature of the surface becomes equal to or lower than a glass-transition temperature of the resin.

7. The image transferring and fixing device according to claim 1, wherein the image forming substance includes wax and resin, wherein the cooling unit cools the wax and resin so that a temperature of the surface becomes between a melting temperature of the wax and a glass-transition temperature of the resin.

8. The image transferring and fixing device according to claim 1, wherein the cooling unit cools a surface of the image forming substance that is in contact with the image carrier.

9. The image transferring and fixing device according to claim 1, wherein the image carrier is an endless belt, wherein the cooling unit is located inside a loop of the belt.

10. The image transferring and fixing device according to claim 1, wherein the image carrier is an endless belt, wherein the tackifying unit is located outside a loop of the belt.

11. An image forming apparatus comprising:

an integrating unit that integrates an image forming substance on an image carrier by applying any one of heat and pressure or both;

a tackifying unit that tackifies a surface of the image forming substance integrated that comes in contact with a recording medium; and a transferring and fixing unit that transfers to and fixes on the recording medium the image forming substance of which surface is tackified, wherein the tackifying unit tackifies the surface by applying a fixing-assisting agent.

12. The image transferring and fixing device according to claim 11, wherein the image carrier is an endless belt, wherein the tackifying unit is located outside a loop of the belt.

13. The image transferring and fixing device according to claim 11, wherein the image carrier is an endless belt.

14. An image forming apparatus comprising:

an integrating unit that integrates an image forming substance on an image carrier by applying any one of heat and pressure or both;

a cooling unit configured to cool the image forming substance;

a tackifying unit that tackifies a surface of the image forming substance integrated that comes in contact with a recording medium; and a transferring and fixing unit that transfers to and fixes on the recording medium the image forming substance of which surface is tackified.

15. The image forming apparatus according to claim 14, wherein the cooling unit is disposed between the integrating unit and the transferring and fixing unit and cools the image forming substance.

16. An image transferring and fixing method comprising:

integrating an image forming substance on an image carrier by applying any one of heat and pressure or both;

cooling the image forming substance;

tackifying a surface of the image forming substance integrated that comes in contact with a recording medium; and transferring to and fixing on the recording medium the image forming substance of which surface is tackified.

17. The image transferring and fixing method according to claim 16, wherein the tackifying includes heating the surface.

18. The image transferring and fixing method according to claim 16, wherein the cooling the image forming substance occurs between the integrating and the transferring and fixing.

19. The image transferring and fixing method according to claim 14, wherein the cooling includes cooling a surface of the image forming substance that is in contact with the image carrier.

20. The image transferring and fixing method according to claim 16, wherein the image carrier is an endless belt, wherein the cooling includes cooling a surface of the image forming substance that is in contact with the image carrier from inside a loop of the belt.

21. The image transferring and fixing method according to claim 16, wherein the image carrier is an endless belt, wherein the tackifying includes tackifying the surface from outside a loop of the belt.

22. An image transferring and fixing method comprising:

integrating an image forming substance on an image carrier by applying any one of heat and pressure or both;

tackifying a surface of the image forming substance integrated that comes in contact with a recording medium; and transferring to and fixing on the recording medium the image forming substance of which surface is tackified, wherein the tackifying includes applying a fixing-assisting agent to the surface.

23. An image forming apparatus comprising:

an integrating unit that integrates an image forming substance on an image carrier by applying any one of heat and pressure or both;

a tackifying unit that tackifies a surface of the image forming substance integrated that comes in contact with a recording medium; and a transferring and fixing unit that transfers to and fixes on the recording medium the image forming substance of which surface is tackified, wherein the integrating unit has a pair of rollers that integrates the image forming substance on the image carrier by applying any one of heat and pressure or both.

24. The image forming apparatus according to claim 23, wherein at least one of the rollers of the pair of rollers is provided with a heating unit inside thereof.

25. The image forming apparatus according to claim 23, wherein bearing stress of the rollers are from 10 $kgf/cm^2$ to 50 $kgf/cm^2$.

26. The image forming apparatus according to claim 23, wherein bearing stress of the rollers are from 0.5 $kgf/cm^2$ to 5 $kgf/cm^2$.

* * * * *